US005895289A

United States Patent [19]

Smith

[11] Patent Number: 5,895,289

[45] Date of Patent: Apr. 20, 1999

[54] RETAINER TO MOUNT A CONNECTOR IN A PANEL

[75] Inventor: Tracy Lee Smith, Harrisburg, Pa.

[73] Assignee: The Whitaker Corporation, Wilmington, Del.

[21] Appl. No.: 08/918,118

[22] Filed: Aug. 27, 1997

[51] Int. Cl.[6] ..... H01R 13/74

[52] U.S. Cl. ..... 439/553

[58] Field of Search ..... 439/567, 563, 439/570, 544, 553, 557

[56] References Cited

U.S. PATENT DOCUMENTS

| | | | |
|---|---|---|---|
| 3,523,269 | 8/1970 | Witek et al. | 439/557 |
| 4,124,267 | 11/1978 | Mines et al. | 339/12 R |
| 4,138,182 | 2/1979 | Muratsuka | 339/89 |
| 4,681,389 | 7/1987 | Nakazawa et al. | 439/557 |
| 5,244,414 | 9/1993 | Peloza | 435/567 |
| 5,254,010 | 10/1993 | Davis | 439/108 |
| 5,468,154 | 11/1995 | Yip et al. | 439/79 |
| 5,525,074 | 6/1996 | Tsuji et al. | 439/555 |

*Primary Examiner*—Gary Paumen
*Assistant Examiner*—Alexander Gilman
*Attorney, Agent, or Firm*—Gerald K. Kita; Anton P. Ness

[57] ABSTRACT

A retainer (1) for a connector (2) terminated to a signal transmitting cable (3) has a first bracket (4) interlocking with an opening (8) through a panel or chassis (6), and over-molding (17) on the connector (2) forming a second bracket (15) interlocking with the first bracket (4), and the first bracket (4) having latch arms (12) latched to the second bracket (15).

9 Claims, 4 Drawing Sheets

Fig. 1
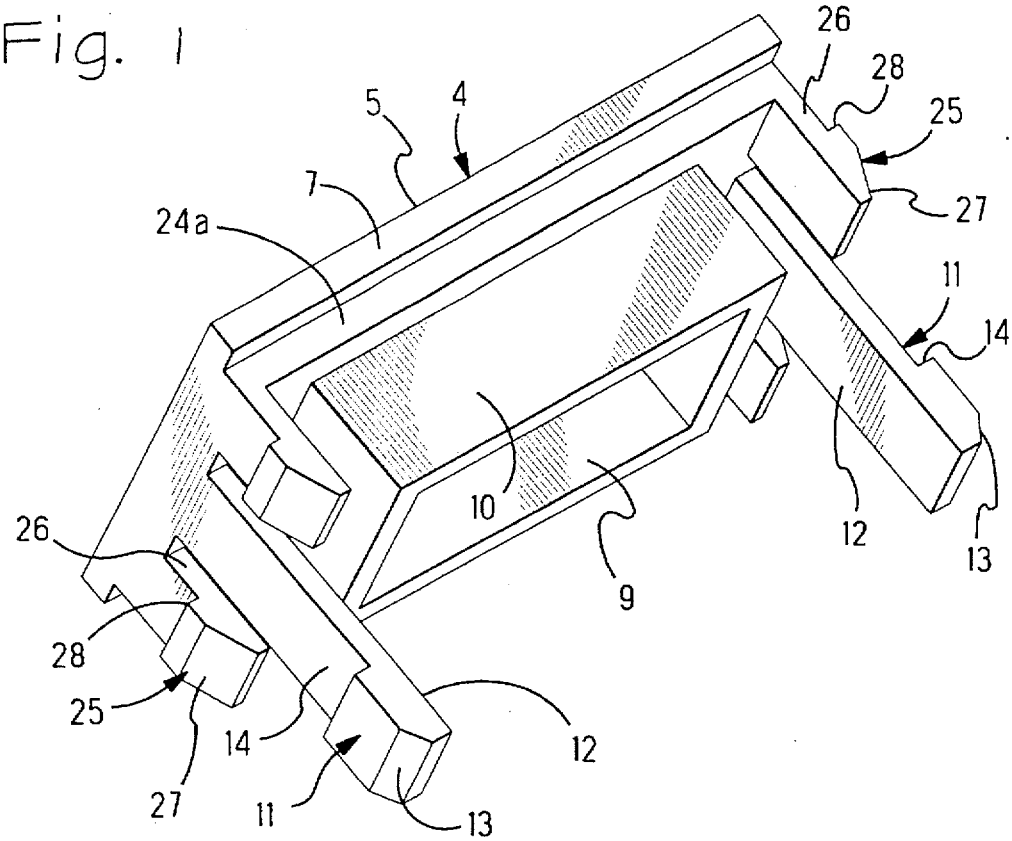
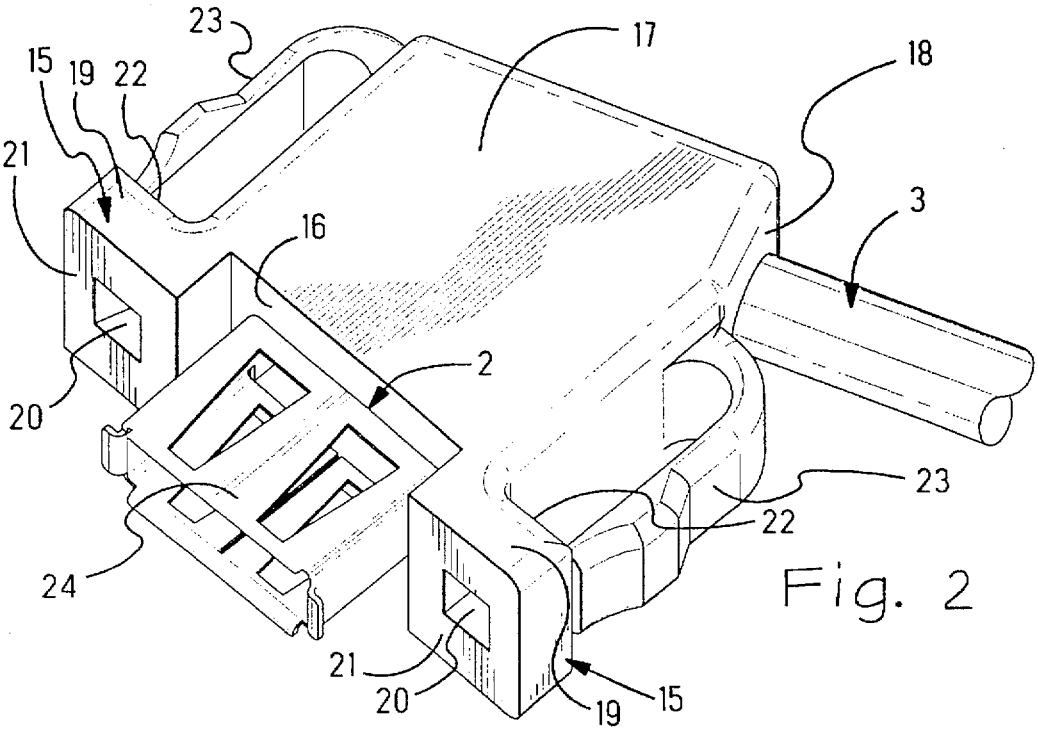
Fig. 2

Fig. 3a
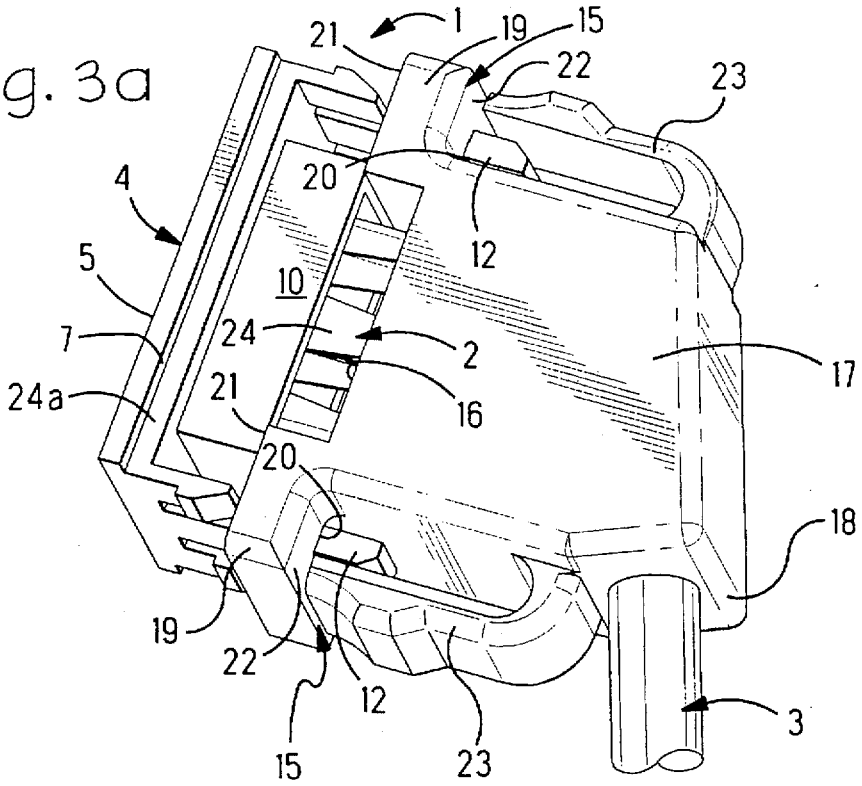
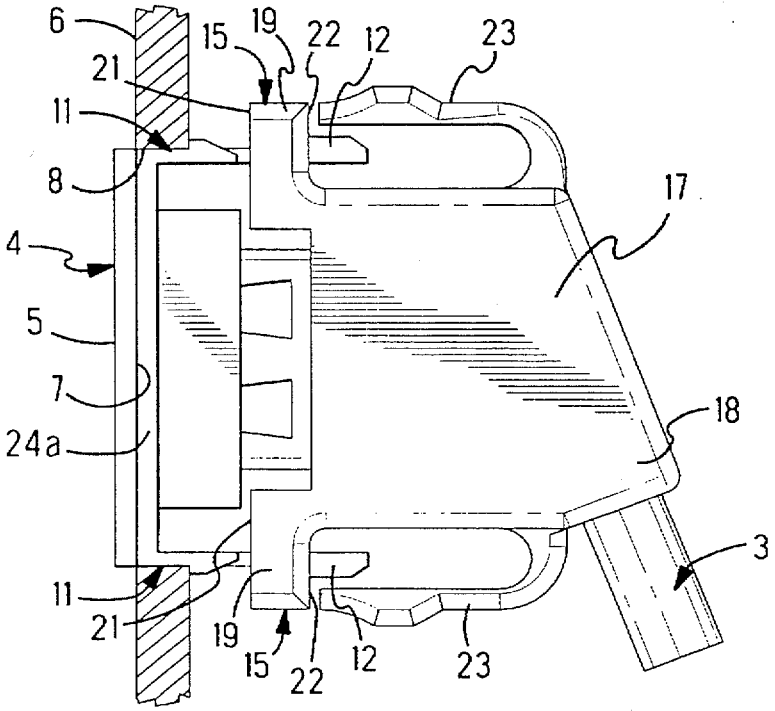
Fig. 3b

RETAINER TO MOUNT A CONNECTOR IN A PANEL

FIELD OF THE INVENTION

The invention relates to a retainer that mounts a connector on a signal transmitting cable, and more particularly, to a retainer that mounts a connector in a panel or chassis of computer equipment.

BACKGROUND OF THE INVENTION

U.S. Pat. No. 5,254,010 discloses a known retainer to mount a connector to a panel. The known retainer provides a bracket on a connector, the bracket surrounds a mating end of the connector, and the bracket is secured to a panel by threaded fasteners that project through the panel. Although threaded fasteners have been the customary way to retain a connector to a panel, a need has developed for a retainer that mounts a connector to a panel without fasteners and without tools that assemble the fasteners to the connector.

SUMMARY OF THE INVENTION

A connector is mounted to a panel by interlocked brackets, eliminating fasteners and tools needed to assemble the fasteners. A retainer according to the invention provides a first bracket fitting into an opening through a panel, and a second bracket on a connector terminated to a signal transmitting cable. The second bracket has an interlocking portion that interlocks with the first bracket, and the second bracket has a latch that latches to the first bracket.

According to a further feature of the invention, the connector terminates a signal transmitting cable, which cable is flexible to move the connector into a position for mounting to a panel. Heretofore, in the known retainer, as disclosed by U.S. Pat. No. 5,254,010, the connector was mounted on a circuit board that was difficult to maneuver into a position for mounting the connector to a panel.

Embodiments of the invention will now be described, by way of example, with reference to the accompanying drawings, according to which:

DESCRIPTION OF THE DRAWINGS

FIG. 1 is an isometric view of a first bracket;

FIG. 2 is an isometric view of a second bracket on a connector terminating a flexible signal transmitting cable;

FIG. 3*a* is an isometric view of the brackets shown in FIGS. 1 and 2, partly assembled;

FIG. 3*b* is an isometric view of an assembly of the brackets shown in FIGS. 1 and 2;

DETAILED DESCRIPTION

Figure 4:
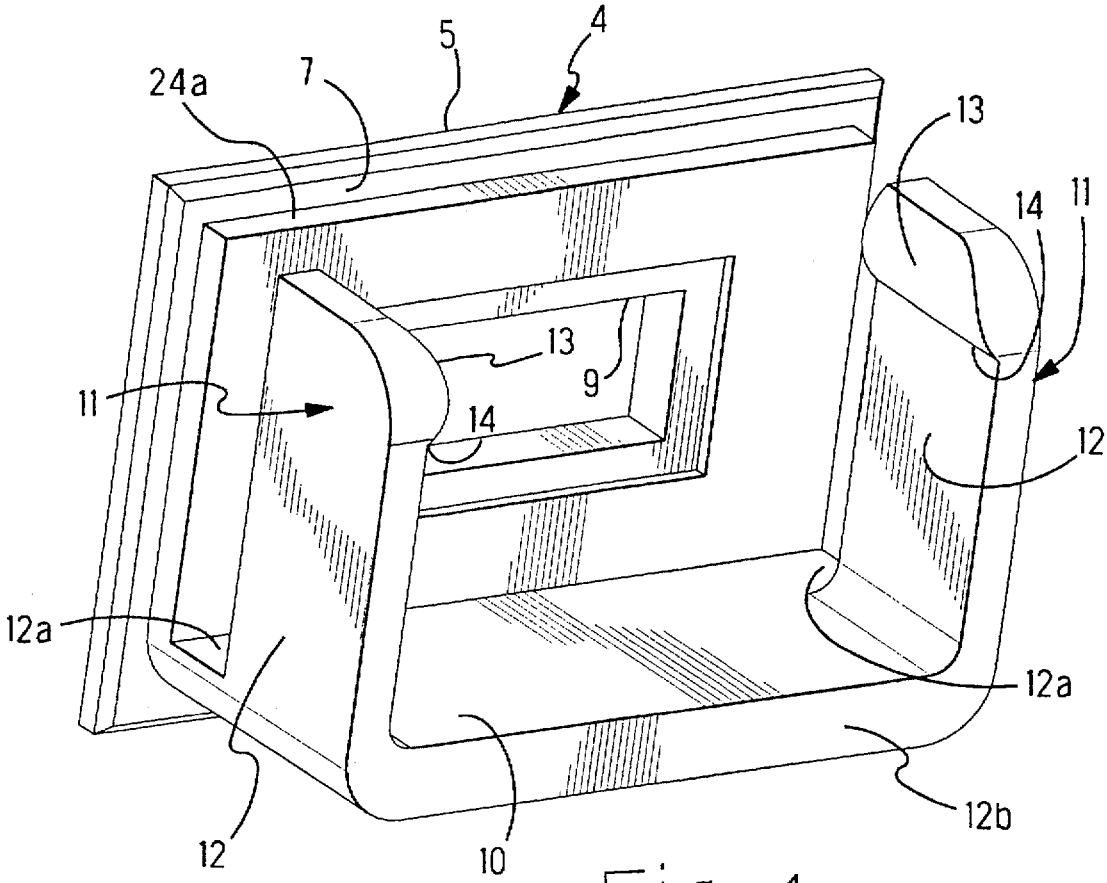
FIG. 4 is an isometric view of another embodiment of a first bracket.
Figure 6:
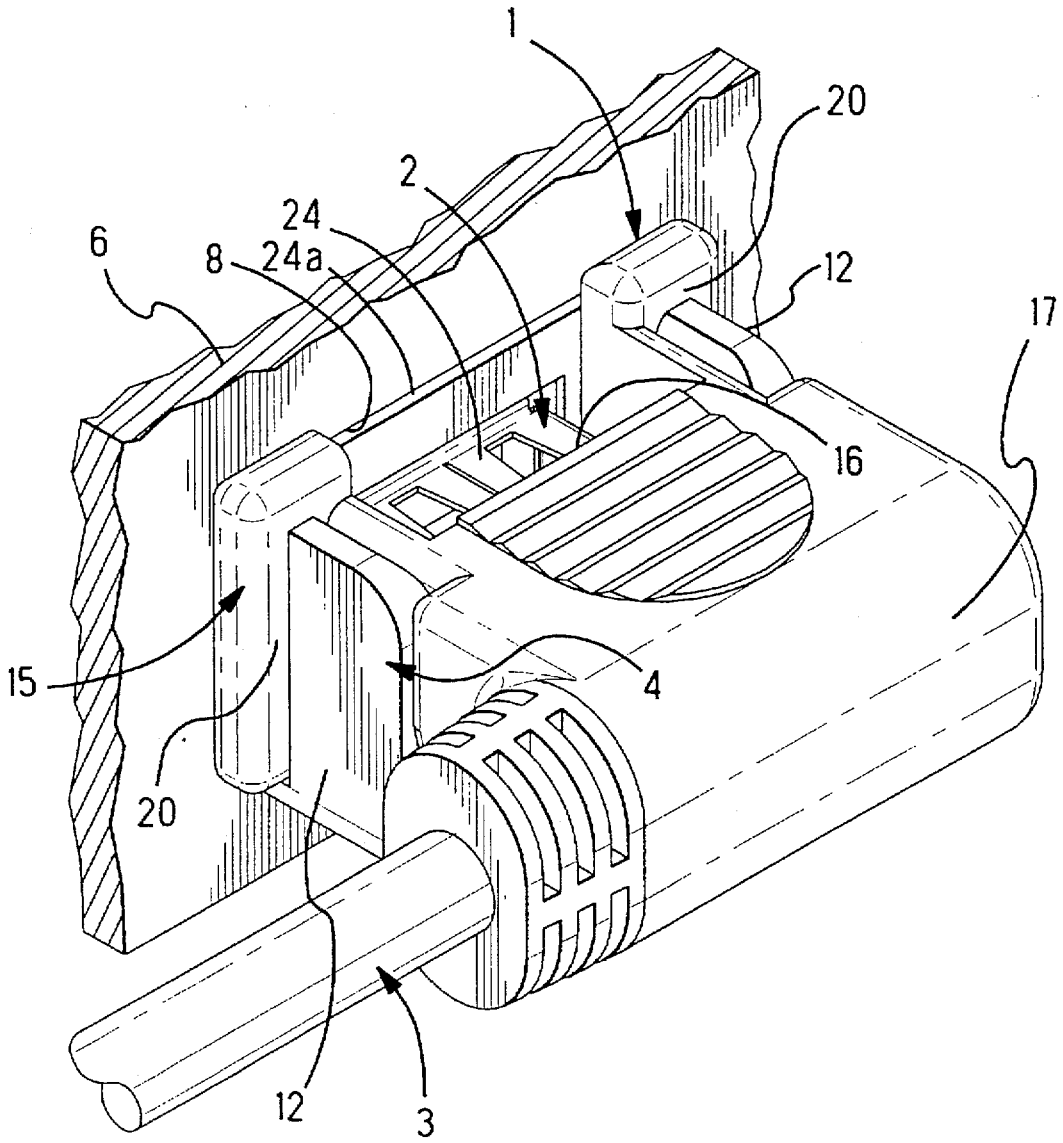
FIG. 6 is an isometric view of an assembly of the brackets shown in FIGS. 4 and 5.

With reference to FIGS. 3*a* and 6, a retainer 1 is assembled with a connector 2 terminated to a signal transmitting cable 3. For example, the connector 2 is a known electrical connector. With reference to FIGS. 1 and 4, a first bracket 4 of unitary construction, for example, of molded plastic construction, has a faceplate 5 for mounting against a front side of a panel or chassis 6, shown in FIG. 6. The faceplate 5 forms a rim 7 surrounding an opening 8 through the panel or chassis 6. An opening 9 through the bracket 4 is aligned with the opening 8 through the panel or chassis 6. With reference to FIG. 1, a shroud 10 extends rearward from the faceplate 5. The shroud 10 extends through the opening 8 through the panel or chassis 6, and surrounds the opening 9 through the bracket 4.

With reference to FIGS. 1 and 4, extending rearward of the rim 7, and spaced inward of the perimeter of the rim 7, is an interlocking section 11 on the first bracket 4. The interlocking section 11 is in the form of a set of resilient latch fingers 12 extending rearward of the faceplate 5, and behind the panel or chassis 6, FIG. 6 and FIG. 3*b*, to which the first bracket 4 is mounted. Adjacent to tapered ends 13 on the latch fingers 12 are projecting shoulders 14.

With reference to FIG. 3*a*, the set of projecting latch fingers 12 extend through the opening 8 in the panel or chassis 6, and behind the panel or chassis 6. The tapered ends 13 of the embodiment shown in FIG. 1, deflect resiliently upon passage through the opening 8 through the panel or chassis 6. The front facing shoulders 14 engage against a back side of the panel or chassis 6 that surrounds the opening 8 through the panel or chassis 6, thus, latching the first bracket 4 in place.

With reference to FIG. 4, another embodiment of the first bracket 4 has an interlocking section 11 in the form of a pair of resilient latch fingers 12 extending parallel to the faceplate 5, and parallel to a panel or chassis 6 to which the first bracket 4 is mounted. Adjacent to tapered ends 13 on the latch fingers 12 are the shoulders 14 facing inward toward each other. The set of projecting latch fingers 12 extend rearward of the faceplate 5, and behind the panel or chassis 6, leaving a space 12*a* between the panel or chassis 6 and each of the latch fingers 12. The latch fingers 12 join a shelf 12*b* that supports the connector 2. The latch fingers 12 and the shelf 12*b* form a U-shaped shroud 10.

Figure 5:
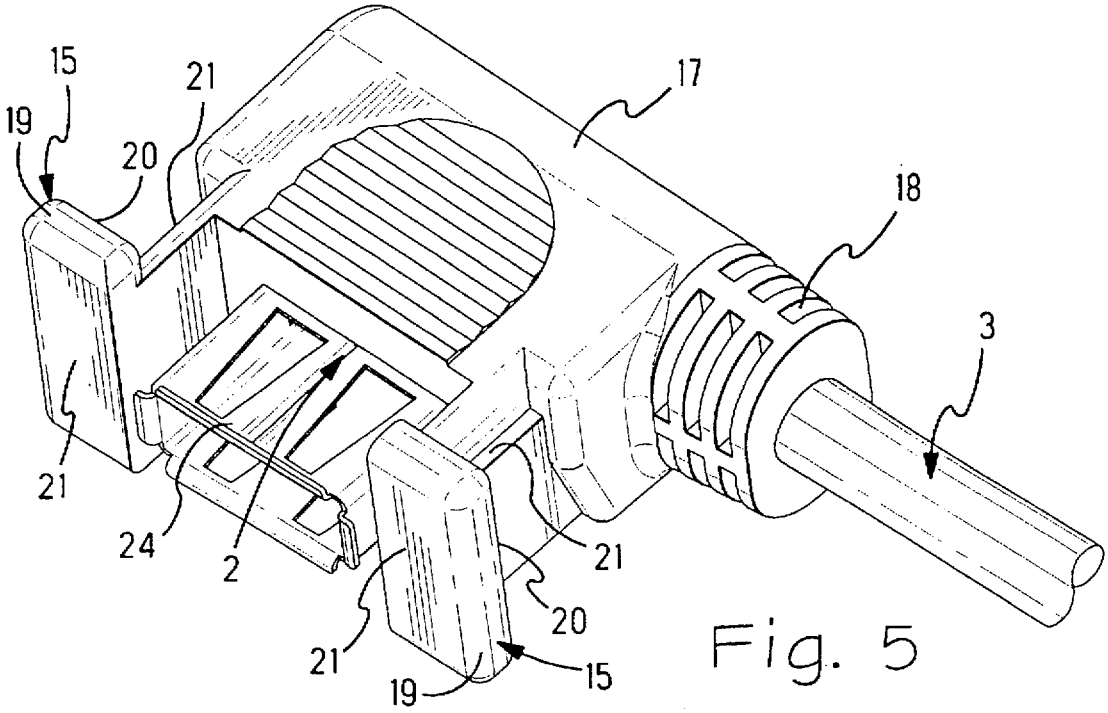
FIG. 5 is an isometric view of another embodiment of a second bracket.

With reference to FIGS. 2 and 5, a second bracket 15 is on the connector 2. The connector 2 terminates the signal transmitting cable 3, and provides a plug connection for the cable 3. The second bracket 15 is adjacent to a mating end 16 of the connector 2. The second bracket 15 is formed by a unitary overmold 17 that surrounds the connector 2. The overmold 17 is formed by a known operation that molds plastic material in situ to surround the connector 2, and to form the bracket 15. The overmold 17 further surrounds a portion of the cable 3 that is connected to the connector to provide a bending strain relief 18 for the cable 3.

The second bracket 15 has an interlocking portion 19 to interlock with the interlocking section 11 on the first bracket 4. The second bracket 15 interlocks and latches to the first bracket 4 to retain the second bracket 15 and the connector 2 on the first bracket 4. With reference to FIG. 2, the second bracket 15 has enclosed passages 20 extending through flanges 21 on opposite sides of the mating end 16 of the connector 2. The enclosed passages 20 end at rear facing shoulders 22 on a back side of the flanges 21. With reference to FIG. 5, another embodiment of the second bracket 15 has open sided passages 20 that extend along back sides of the flanges 21. The open sided passages 20 end at shoulders 22 that extend rearward from the back sides of the flanges 21.

With reference to FIGS. 3*a*, 3*b* and 6, the passages 20 are aligned with the latch fingers 12. The latch fingers 12 of the first bracket 4 extend along the passages 20, and are deflected resiliently by being moved along the passages 20. When the latch fingers 12 extend beyond the passages 20, the shoulders 14 on the latch fingers 12 register against the shoulders 22 on the second bracket 15 to latch the second bracket 15 to the first bracket 4, and resist withdrawal of the second bracket 15 from the latch fingers 12. The opening 9 through the first bracket 4 aligns a mating end 16 of the connector 2 with the opening 8 through the panel 6.

With reference to FIG. 3*a*, the connector 2 is adapted for disassembly from the first bracket 4. The overmold 17 has a pair of resilient arms 23 that are cantilever beams attached to the remainder of the overmold 17. The arms 23 overlap the latch fingers 12 where they extend beyond the passages 20. The arms 23 are resiliently deflected inwardly toward the connector 2 urging against the latch fingers 12, and releasing the shoulders 14 on the latch fingers 12 from the shoulders 22 on the second bracket 15.

With reference to FIGS. 2 and 5, the connector 2 has a conducting shield 24 extending forwardly from the mating end 16 of the connector 2. The shield 24 is stamped and formed from metal, and encircles the mating end 16 to provide an electrical shield. The shield 24 extends forwardly into the shroud 10 that encircles the shield 24 and protects the shield 24 from damage. The shield 24 provides a lining in the opening 9 through the first bracket 4. The opening 9 through the first bracket 4 aligns both an open front of the shroud 12, and the mating end 16 of the connector 2, with the opening 8 through the panel or chassis 6.

With reference to FIGS. 1 and 4, extending rearward of the rim 7, and spaced inward of the perimeter of the rim 7, is a second interlocking section 24*a* on the bracket 4 to interlock with the panel or chassis 6 surrounding the opening 8. The interlocking section 24*a* is in the form of a plug that fits within a perimeter of the opening 8 through the panel or chassis 6, while the rim 7 engages a front side of the panel or chassis 6.

With reference to FIG. 1, a latching section 25 on the first bracket 4 has a set of projecting latch fingers 26 to extend through the opening 8 in the panel or chassis 6 to latch against a back side of the panel or chassis 6. The latch fingers 26 extend perpendicular to the faceplate 5, and perpendicular to the panel or chassis 6 to which the faceplate 5 is mounted. The latch fingers 26 are resilient, and have tapered ends 27 that deflect resiliently upon passage through the opening 8 in the panel 6. Adjacent to the tapered ends 27 are front facing shoulders 28 that latch against a back side of the panel or chassis 6 that surrounds the opening 8 through the panel or chassis 6.

With reference to FIG. 4, the first bracket 4 is latched to the panel or chassis 6 by the second bracket 15 being mounted with the flanges 21 inserted behind the back side of the panel or chassis 6, and lying between the back side and the latch fingers 12.

Although preferred embodiments of the invention have been described, other embodiments and modifications are intended to be covered by the spirit and scope of the appended claims.

What is claimed is:

1. A retainer for a connector terminated to a signal transmitting cable, comprising:

a first bracket fitting into an opening through a panel, a first interlocking section on the bracket to interlock with the panel surrounding the opening, a second interlocking section on the bracket, a second bracket on the connector terminated to the signal transmitting cable, the second bracket having an interlocking portion interlocking with the second interlocking section, the first bracket having a latch that latches to the second bracket to retain the second bracket and the connector on the first bracket, and an opening through the first bracket aligning a mating end of the connector with the opening through the panel.

2. A retainer as recited in claim 1 wherein, the first bracket has a first set of projecting latch fingers extending through the opening in the panel and latching to the second bracket, and a second set of projecting latch fingers extending through the opening in the panel and latching against a back side of the panel.

3. A retainer as recited in claim 1 wherein, the first bracket has a first set of projecting latch fingers extending through the opening in the panel and latching to the second bracket, the first bracket has a second set of projecting latch fingers extending through the opening in the panel and latching against a back side of the panel, and the connector has resilient fingers overlapping the second set of latch fingers and releasing the second set of latch fingers from the second bracket by deflection of the resilient fingers against the second set of latch fingers.

4. A retainer as recited in claim 1 wherein, a flange on the second bracket is received between a back side of the panel and a set of latch fingers on the first bracket, and shoulders on the first bracket latch to the second bracket.

5. A retainer as recited in claim 1 wherein, the first bracket provides a rim surrounding the opening through the panel.

6. A retainer as recited in claim 1 wherein, the connector has a conducting shell projecting forwardly within the opening through the panel.

7. A retainer as recited in claim 1 wherein, a conducting shield on the connector is in alignment with the opening through the panel.

8. A retainer as recited in claim 1 wherein, a conducting shield on the connector is in alignment with the opening through the panel, and a shroud on the first bracket receives the shroud.

9. A retainer as recited in claim 1 wherein, resilient arms on the connector overlap the latch fingers on the first bracket.

* * * * *